US007043895B2

(12) United States Patent
Mace

(10) Patent No.: US 7,043,895 B2
(45) Date of Patent: May 16, 2006

(54) ARTICULATED STRAP WITH LINKS

(75) Inventor: Jean-Sébastien Mace, Cran Gevrier (FR)

(73) Assignee: Rolex S.A., Geneva (CH)

( * ) Notice: Subject to any disclaimer, the term of this patent is extended or adjusted under 35 U.S.C. 154(b) by 145 days.

(21) Appl. No.: 10/726,417

(22) Filed: Dec. 2, 2003

(65) Prior Publication Data

US 2004/0134183 A1 Jul. 15, 2004

(30) Foreign Application Priority Data

Dec. 11, 2002 (EP) ..... 02406089

(51) Int. Cl.
*F16G 15/04* (2006.01)
*G04B 37/00* (2006.01)
*A44C 5/10* (2006.01)

(52) U.S. Cl. ..... 59/80; 59/82; 63/4

(58) Field of Classification Search ..... 59/80, 59/82, 84, 85, 801, 901; 63/4
See application file for complete search history.

(56) References Cited

U.S. PATENT DOCUMENTS 5,038,557 A * 8/1991 Otsuki et al. ..... 59/80
6,026,637 A * 2/2000 Dombre et al. ..... 59/80
6,318,064 B1 * 11/2001 Vandini ..... 59/80
6,488,404 B1 * 12/2002 Zurcher et al. ..... 59/80
2001/0022073 A1 9/2001 Vandini

FOREIGN PATENT DOCUMENTS

EP 1 048 240 11/2000
GB 2260072 4/1993

* cited by examiner

*Primary Examiner*—David Jones
(74) *Attorney, Agent, or Firm*—Sturm & Fix LLP

(57) ABSTRACT

This articulated strap with links has a succession of modular assemblies, each comprising two articulated parts assembled to one another about a transverse center pin and equipped with means for receiving, on either side of this center pin, two transverse connecting articulation rods which are integral, on the one hand, with one of said articulated parts and issue laterally into a set-back portion of said modular assembly and, on the other hand, are integral with said two articulated parts and issue laterally from two projecting portions of said modular assembly, in such a way that, when said two articulated parts are aligned in order to receive one of said rods, the other of these rods is locked angularly about said transverse center pin.

16 Claims, 6 Drawing Sheets

ARTICULATED STRAP WITH LINKS

CROSS REFERENCE TO RELATED APPLICATIONS

This application claims priority of European Application No. 02406089.9 filed Dec. 11, 2002, which is included in its entirety by reference made hereto.

BACKGROUND OF THE INVENTION

1. Field of the Invention

The present invention relates to an articulated strap with links which are arranged so as to penetrate one into the other in the longitudinal direction and are connected by means of transverse hinge pins.

2. Description of the Related Art

Straps of this type are known, in particular watch straps, in which at least some transverse series of adjacent links are demountable in order to make it possible to alter the length of the strap as a function of the size of the wrist of the wearer of this strap. In general, these demountable transverse series of links are assembled by means of screws which are visible on the edge of the strap. The other transverse series of links are connected by means of studs driven into the lateral links, in order to allow these to pivot with respect to the central links.

Apart from the fact that the screws are visible, such a strap is not fully demountable and requires delicate action to separate the links held by studs, should it become necessary to change a link.

EP-0089 421, WO 93/08713 and WO 94/12069 have already proposed demountable articulated straps assembled by means of articulation elements engaged freely on pivot pins, these articulation elements being locked by means of members screwed to that side of the strap which faces the wearer's arm, so that the screws are not visible when the strap is worn. This is firmly an improvement in aesthetic terms, although it could not fulfill the most demanding criteria associated with articles which are top of the range. To be precise, in a showcase or at the time of purchase, the customer first sees the strap when it is not being worn, and he can therefore see the fastening screws, whatever the face of the strap on which they appear. Seeing the screws immediately gives such a strap the character of an article where the functional aspect has superseded the aesthetic aspect, and this obviously does not add to the value of a top-of-the range article of this type, the faultless appearance of which is a token of its good workmanship.

The patent CH-558 153 relates to an articulated strap comprising links integral with a transverse articulation rod which projects at one end of the link and does not extend over the entire width of the latter. This rod is introduced into a receptacle opening onto the lower face of the adjacent link and is held in place by a spring-type locking element. In this case, the screws are replaced by a spring. Where a strap made from gold is concerned, it will be difficult for such a spring to be produced from the same metal as the strap. Moreover, although there is no screw, this fastening member must have an orifice to allow demounting and therefore retains a functional and non-decorative character giving it an appearance whose aesthetic value is not in keeping with the rest of the strap.

Another solution has been proposed in CH-688 430, which involves forming links comprising three parts of different widths which are offset longitudinally in relation to one another. A narrow central part is followed by a part of intermediate width, extending on either side of the mid-axis of the strap, and finally by a part, the width of which corresponds to that of the strap. Each central part and each part of intermediate width is pierced transversely to the strap. Each wide part of the link comprises a clearance having a width corresponding to the intermediate width, and each intermediate part comprises a clearance having a width corresponding to the narrowest central part. Consequently, two adjacent links can fit one into the other and be retained together by means of a bar slipped into the coaxial transverse orifices of the intermediate parts and of the central part of the adjacent link. This bar passes freely through these orifices, but is retained axially as soon as the next link is put in place. To be precise, the bar comes into abutment against the edges of the clearance of corresponding width of this next link and is therefore blocked axially. The main disadvantage of this solution is that the amplitude of articulation of the links must be limited so as to ensure that the bar is always in abutment against the edges of the clearance of the next link. Moreover, with this solution, the links are necessarily offset longitudinally in relation to one another.

Finally, EP 0 310 536 has proposed a strap comprising two rows of lateral links, each integral with a half-shaft which terminates in a head adjacent to a groove. Two intermediate links are arranged between these lateral links and a central link. The intermediate links have two parallel passages with transverse axes, one of which passages is intended for receiving a half-shaft, at the same time allowing the head and the adjacent groove to project. The central fastening link possesses a longitudinal recess, the cross section of which is of a shape complementary to that of the two heads of the two half-shafts. The longitudinal recess opens at one end and has two lateral slots, the width of which corresponds to the diameter of the grooves adjacent to the heads of the half-shafts.

To mount the strap, the two half-shafts are engaged into the respective passages of two intermediate links, and then the two heads of the half-shafts are introduced into the longitudinal recess from the open end of the latter. Each pair of intermediate lateral links is slid along longitudinally until the other passages of the intermediate links coincide with the passage of the central link. A pivot rod is then introduced through the two passages, in such a way that all the links forming the strap are articulated about two axes.

Although such a strap does not comprise any screws and no element forming part of the assembly is visible in the position of use, that is to say when the strap surrounds the wrist, that end of the longitudinal recess which issues onto a lateral face of the strap becomes visible as soon as a sufficient angle is formed between this lateral face and the link adjacent to this lateral face.

BRIEF SUMMARY OF THE INVENTION

The object of the present invention is to provide an articulated strap with links, in which no assembly element is visible on any face, even a lateral face of links which is located within the strap. The object of this invention is also to have the least possible or even no screw-type assembly element, in order to avoid any risk of the unscrewing of a screw which is not sufficiently tightened.

To achieve this, the subject of this invention is an articulated strap with links as claimed.

Despite the absence of screws between the modular assemblies which form the strap, the latter is fully demountable without any tool, thus making it possible to adjust it to the correct length easily at the time of the sale of a watch in the case of a watch strap.

The locking of the transverse articulation rods of this strap is obtained by means of the tilting of the two parts of a modular assembly about the transverse mid-axis, said tilting being intended to cause the two links aligned transversely with the transverse articulation rod to coincide. Thus, putting in place each modular element makes it possible, by the two parts of the modular assembly being immobilized in terms of rotation about the transverse mid-axis, to lock the transverse articulation rod axially between the lateral faces turned toward the inside of the two respective links of the lateral rows, and even between a lateral face of a link of one lateral row and the link of the opposite lateral row when the rod is integral with the latter link.

Preferably, the transverse articulation rods are free, so that their wear occurring as a result of the oscillation of the two modular elements about it is reduced to a minimum.

Other particular features and advantages of the strap which is the subject of this invention may be gathered from the following description made with the aid of the accompanying drawings which illustrate diagrammatically and by way of example, one embodiment and different variants of the articulated strap with links which is the subject of the present invention.

DETAILED DESCRIPTION OF THE INVENTION

Figure 1:
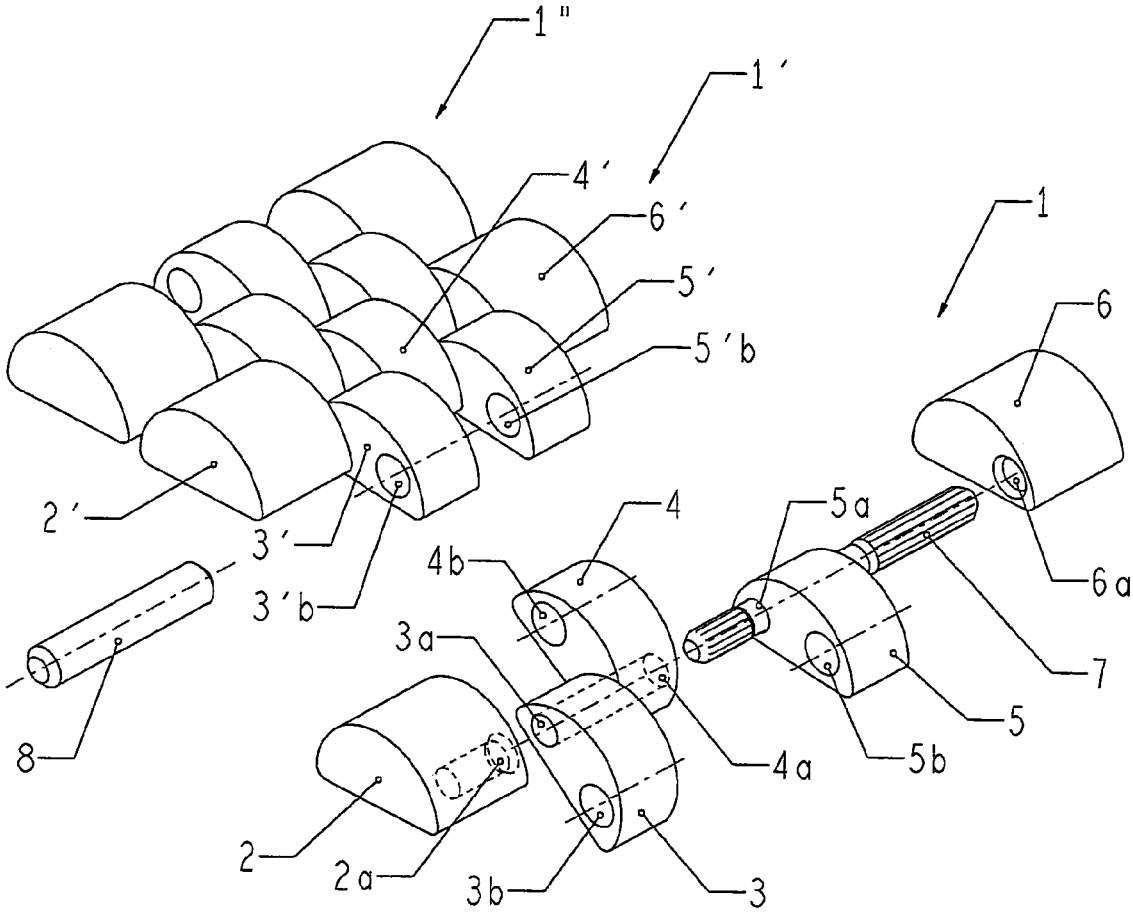
FIG. 1 is an exploded perspective view of one of the modular elements which form the strap.

The strap according to the invention is formed from a succession of similar modular assemblies 1 which are articulated one on the other, one of which is illustrated, before assembly, in FIG. 1. This modular assembly comprises five adjacent links 2, 3, 4, 5, 6 in the transverse direction of the strap, each of them forming part of one of the five longitudinal rows of links forming the strap. These links 2–6 occupy alternately two longitudinal positions and are connected to one another by means of a first transverse center pin 7 which passes freely through transverse guide orifices 3*a*, 4*a*, 5*a* of the links 3–5 and the two ends of which are driven into blind holes 2*a*, 6*a* formed in the inner lateral faces of the two lateral links 2 and 6. Consequently, when the modular assembly 1 is in the assembled position, the two lateral links 2, 6 and the central link 4 are aligned in one of the two longitudinal positions, while the two links 3, 5 are aligned transversely in the second longitudinal position and form two projections which are intended to penetrate into two set-back parts of an adjacent modular assembly which are formed between the three links 2, 4 and 6.

These two links 3, 5 and the central link 4 each comprise a second transverse guide orifice 3*b*, 4*b* and 5*b* respectively, which passes through their respective parts offset in relation to the transverse center pin 7 and all three located at the same distance from this pin. One of the links 3, 5 is integral with the adjacent lateral link 2 or 6, while the other of these links 3, 5 is integral with the central link 4. Since the two lateral links 2, 6 are driven onto the connecting pin 7 and since one of them is integral with the adjacent link 3 or 5, three links are integral with the transverse center pin 7 and form a first part of the modular assembly 1. The other two links 4 and 3 or 5 are integral with one another and form a second part of the modular assembly 1, but are free to rotate about the transverse center pin 7.

It should be noted that the two pairs of adjacent links integral with one another may be produced from two pieces welded or fastened in any other suitable way to one another. These two pairs of integral links could also each consist directly of one piece, thus giving the appearance of being produced from two assembled pieces. However, in view of the fact that the strap obtained gives the appearance of being formed from five longitudinal rows of links offset alternatively in the longitudinal direction, to make the explanations simpler they will be considered as two integral links, even though they are in actual fact formed directly from one piece.

Figure 2:
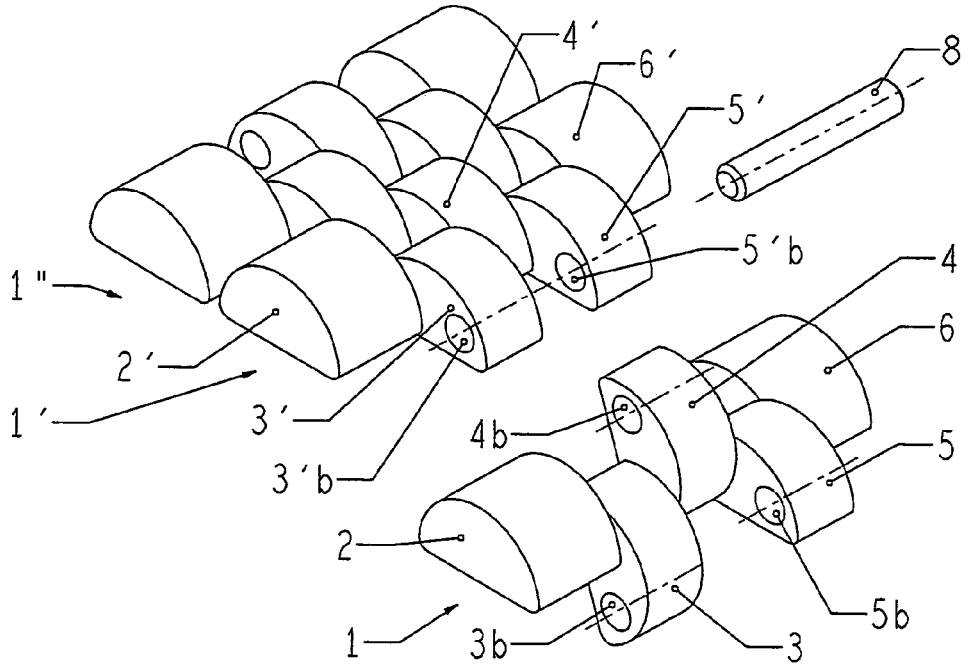
FIG. 2 is a perspective view of a strap portion with a modular element according to FIG. 1 in a first phase of a process of assembling it.

Since the central link 4 and one of the links 3, 5, in this example the link 3, which are integral with one another, are free to rotate about the transverse center pin 7, once the modular assembly 1 is assembled, as illustrated in FIG. 2, these links 3, 4 can be rotated through approximately 90° about the transverse center pin 7, as illustrated in FIG. 2, in order to free the transverse orifice 4*b* from the space located between the lateral links 2, 6 and allow access axially to said orifice, which is not possible when the latter is located in the space between the lateral links 2, 6.

Figure 3:
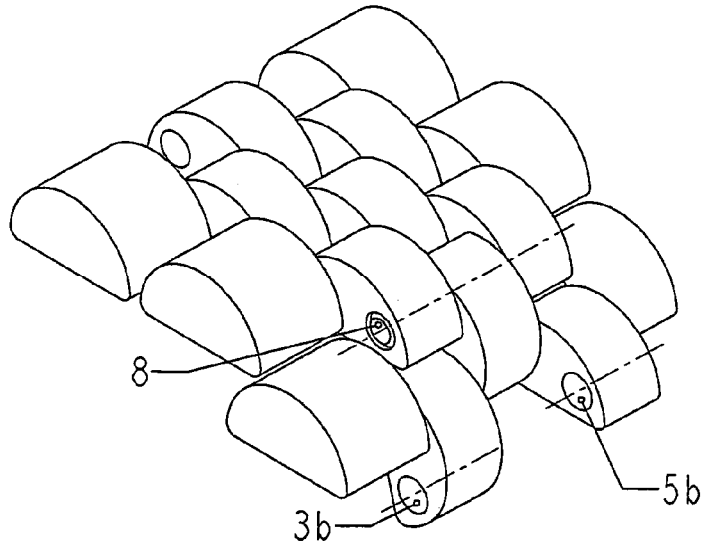
FIG. 3 is a view, similar to that of FIG. 2, illustrating a second assembly phase.

Once this transverse orifice 4*b* has been positioned, as illustrated in FIG. 2, the link 4 can be introduced between the links 3' and 5' of the modular element 1' which is located at the front end of the strap portion to which the modular element 1 is to be added. The transverse orifice 4*b* of the link 4 must be aligned with the orifices 3'*b*, 5'*b* of the links 3', 5' of the modular element 1', thus making it possible to put in place a transverse articulation rod 8, as illustrated in FIG. 3.

To block this transverse articulation rod 8 transversely, the two links 3, 5 integral with one another must be tilted about the transverse center pin 7, until the transverse guide orifices 3'*b*,5'*b* of the links 3,5 are aligned transversely. In this position, the two parts 3, 5 of the modular assembly are aligned, that is to say their lower plane faces are located on one and the same plane. The inner lateral faces of the lateral links 2, 6 come into position against the adjacent lateral faces of the links 3' and 5' respectively, thus closing the ends of the transverse orifices 3'*b*, 5'*b* and thereby locking the transverse articulation rod 8 axially.

Simultaneously, once the transverse articulation rod 8 is engaged in the transverse orifices 3'*b*, 5'*b* of the links 3' and 5', it makes the two parts, that formed from the integral links 3, 4, on the one hand, and that formed from the links 2, 5, 6 integral with the pin 7, on the other hand, integral with one another, in such a way that the modular element 1 then forms an element of which all the links are integral with one another, the transverse articulation rod 8 alone ensuring the articulation of the two adjacent modular assemblies 1, 1'. Thus, whenever a transverse articulation rod 8 connects the two links 3, 5 belonging respectively to the two parts of a modular element 1 which are capable of rotating relative to one another about the connecting pin 7, these two parts are immobilized and then form only a single modular assembly articulated on the adjacent modular assembly about the sole axis 8.

Consequently, since the modular assemblies 1, 1', . . . , each pivot about the sole rod 8, the inner lateral faces of the lateral links 2, 6, said lateral faces performing the function of axial abutments at the two ends of this rod 8, remain fixed in relation to the latter, thus preventing it from emerging from the transverse orifices 3'*b*, 4*b*, 5'*b* formed in the links 3', 4, 5' of two adjacent modular assemblies 1, 1' connected by means of this rod 8. The assembly from that moment on becomes undemountable.

The strap can be demounted, but always starting from the end at which the mounting of the modular assemblies 1, 1', . . . , was terminated. First, the last transverse articulation rod 8 put in place is removed, in order to allow the two parts of the modular assembly 1, which are formed respectively from the links 2, 5, 6 integral with the transverse center pin 7 and from the links 3, 4 to pivot in relation to one another, so as to permit the emergence of the next transverse articulation rod 8, for the purpose of separating the two adjacent modular assemblies 1, 1'. The two parts, formed from two or three links integral with the transverse center pin 7 of each modular assembly 1, are thereby released from one another one at a time, thus allowing the successive demounting of all the modular assemblies 1, 1', . . . .

Figure 5:
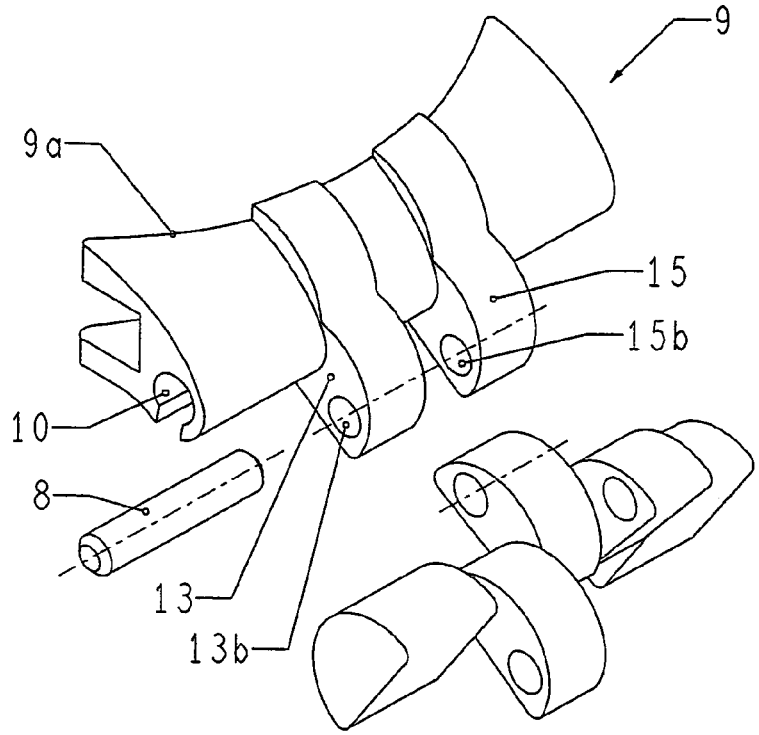
FIG. 5 is a perspective view showing a connecting element between one end of the strap and a watch case.

In order to connect the first modular assembly 1, for example, to a watch case (not illustrated), and since it is no longer possible to have access to the transverse orifice 4*b* of the central link 4, once the two abovementioned parts forming the modular assembly 1, 1' have been immobilized by the transverse articulation rod 8, one possible solution for avoiding the need to demount the strap will be given here by way of example. One of these solutions is illustrated here in FIG. 5.

For this purpose, at the start of mounting of the strap, to begin, the first modular assembly 1 can be connected to a connecting member 9 which comprises a passage 10 intended for receiving a bar (not illustrated) for fastening to the horns of a watch case between which the connecting member 9 is adjusted, the width of this connecting member 9 corresponding to the distance between the horns of the case, and its face 9*a* adjacent to the outer face of the case matching the contour of the latter, so that, when the bar arranged in the passage 10 is fastened to the horns of the case, this connecting member 9 becomes integral with the latter.

Figure 4:
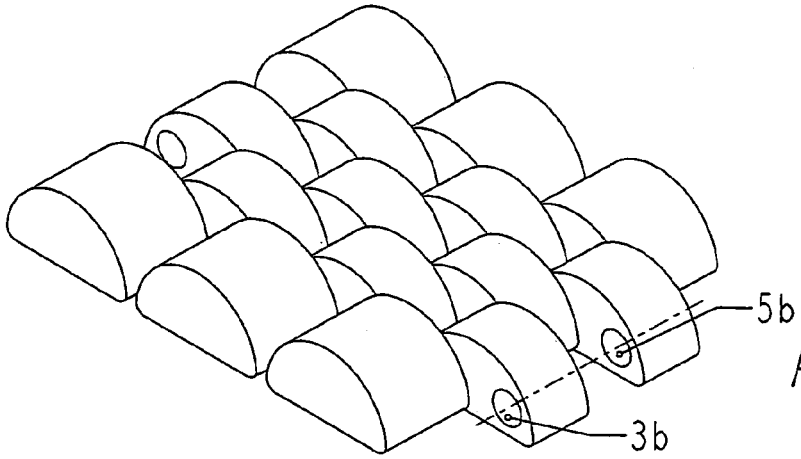
FIG. 4 is a view, similar to the preceding figure, illustrating the last assembly phase.

This connecting member 9 comprises two projections 13 and 15, of which the shape, spacing and dimensions correspond to the links 3, 5 of a modular assembly 1, but these projections 13, 15 are integral with the connecting member. Under these conditions, the central link 4 of a modular assembly 1 can be introduced between the two projections 13, 15 and fastened to these projections by means of a transverse articulation rod 8 identical to that connecting all the modular assemblies 1, 1', . . . , to one another and passing through the transverse orifice 4*b* of the central link 4 and coaxial orifices 13*b*, 15*b* passing respectively through the projections 13 and 15. Once this connection has been made, the next modular assemblies 1, 1', . . . , can be added by being connected to one another, as described above with regard to the FIGS. 2–4.

Figure 6:
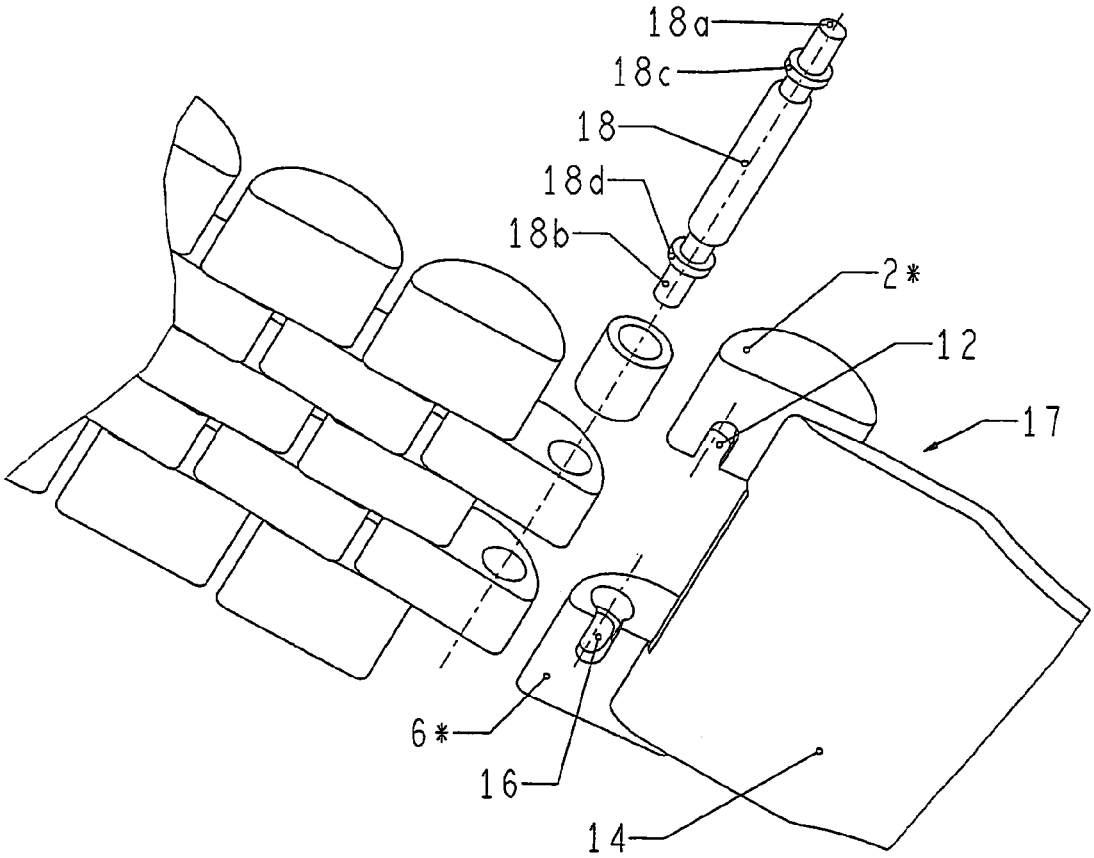
FIG. 6 is a perspective view showing a first means for fastening one end of the strap to a clasp element.

To make it possible to demount the strap, the last transverse articulation rod 8, intended, in the case of a watch strap, for connecting the strap to a clasp, will advantageously consist, according to a first variant, as illustrated in FIG. 6, of a spring bar 18 of a known type, which passes through the orifices 3*b*, 5*b* of the links 3 and 5 respectively. This spring bar comprises at least one end 18*a* formed by a piston mounted slidably with respect to the bar body 18 which contains a helical spring (which cannot be seen) exerting a constant axial pressure on the piston 18*a*, thus tending to cause the latter to emerge from the bar body 18. The other end 18*b* of this bar 18, which may also be formed by a sliding piston, is introduced into a receptacle 16 of a fastening member in the form of a link 6* integral with a blade 14 of an unfolding-loop clasp 17. The bottom of this receptacle 16 terminates in a blind hole (which cannot be seen), in which the end 18*b* of the bar 18 is engaged. Axial pressure exerted on the other end 18*a* makes it possible to cause the piston or pistons integral with the ends 18*a*, 18*b* to retract into the body of the bar 18, until an annular abutment 18*c* and 18*d* butts against the bar body 18. The shortened length of the bar 18 then makes it possible to engage the other end 18*a* into a receptacle 12 of a fastening member in the form of a link 2* integral with the blade 14 of the clasp 17. By the axial pressure on the bar 18 being released, the end 18*a* of the latter engages into a blind hole located at the bottom of the receptacle 12, thus implementing the removable fastening of the strap to the clasp 17.

Each receptacle 16, 12 opens laterally onto the lower face (that facing the wearer's arm) of the links 2*, 6* integral with the blade 14 of the clasp 17, in order to allow access to the annular abutments 18*c*, 18*d* for the purpose of retracting the piston or pistons 18*a*, 18*b* of the bar axially so as to detach the strap from the clasp 17.

Figure 7:
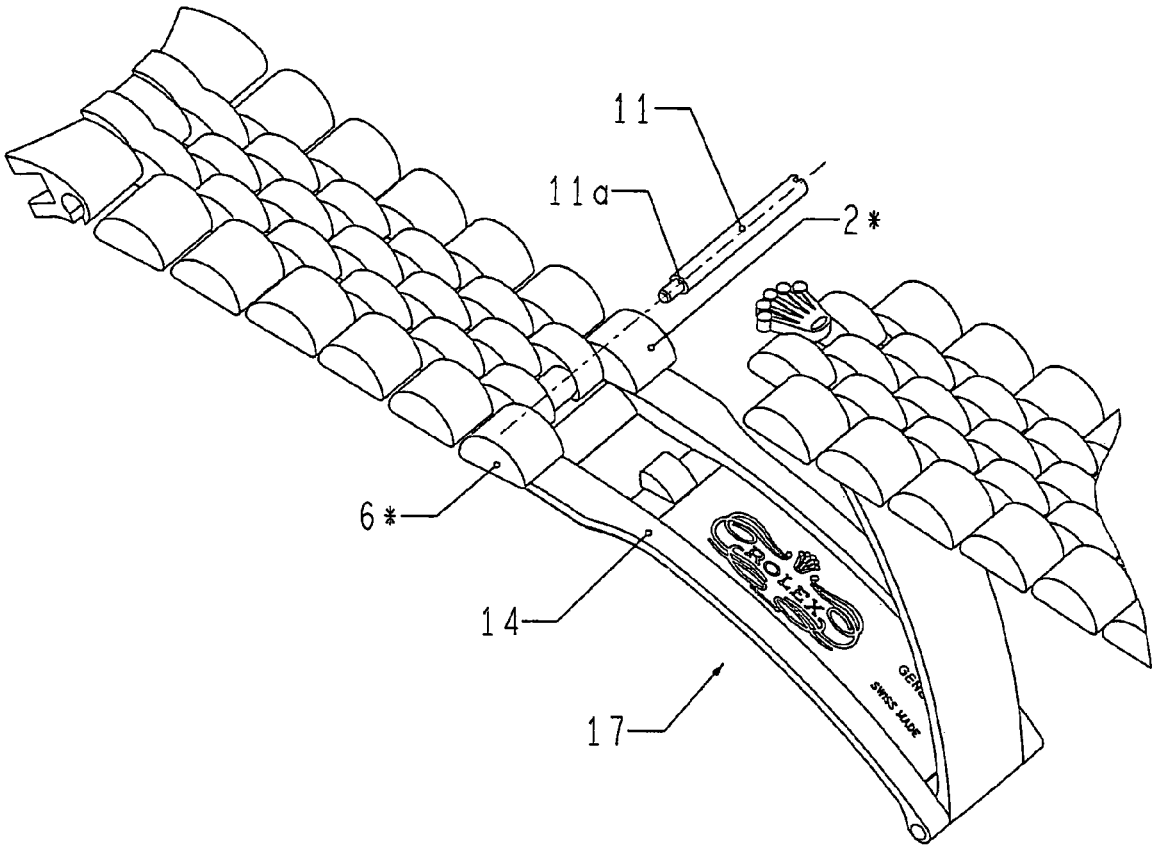
FIG. 7 is a perspective view illustrating a variant of FIG. 6.

As a variant and as illustrated in FIG. 7, the need to make the lateral orifices of the receptacles 16, 12 which appear on the back of the strap can be avoided by the bar 18 being replaced by a connection and articulation rod 11, one end 11*a* of which is threaded, while the opposite end has a diametral slot 11*b* in order to make it possible to screw the end 11*a* into a thread formed in the link 6* of the blade 14 of the clasp 17. This rod 11 likewise passes through a transverse orifice passing through the other link 2* integral with the blade 14 of the clasp 17 and also through the orifices 3*b*, 5*b* of the links 3 and 5 at the end of the strap.

In the embodiment of the strap described with reference to FIGS. 1 to 4, the strap grows from one end toward the other end.

Figure 8:
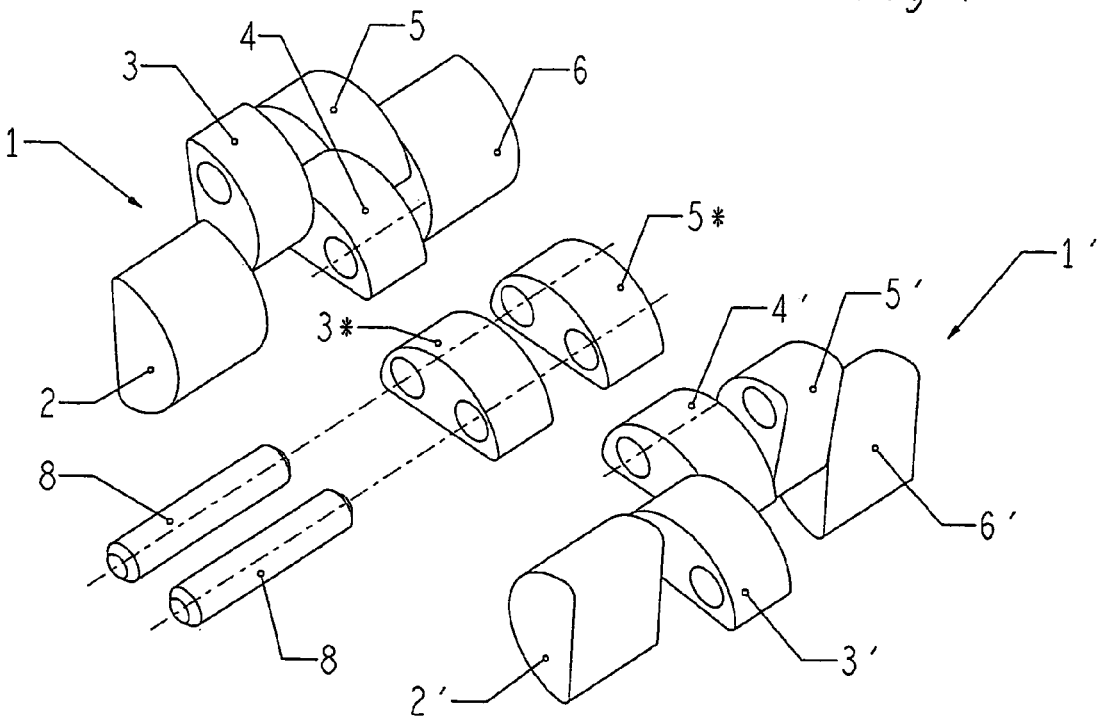
FIG. 8 shows a variant of a modular assembly of the strap according to the invention, designed to make it possible to lengthen or shorten the strap from its two ends.

The variant illustrated in FIG. 8 shows how it is possible for the strap according to the invention to grow or to be shortened from its two ends. It is sufficient, for this purpose, to arrange two modular assemblies 1, 1' mirror-symmetrically in relation to one another on either side of a transverse pin of the strap, with their two transversely aligned links 3, 5, or 3', 5' turned toward the ends of the strap, as illustrated in FIG. 8. Subsequently, these two modular assemblies are connected by means of two independent links 3*, 5* arranged between the lateral links 2, 6 and the central link 4 of the modular assembly 1 and between the lateral links 2', 6' and the central link 4' of the modular assembly 1'. These independent links 3*, 5* are connected to the central link 4, 4' of the modular assemblies 1 and 1' by means of two transverse articulation rods 8 which will be locked when the central links 4, 4' of the modular assemblies 1, 1' are made integral with the transverse center pin 7 of each of these modular assemblies 1, 1' by means of a transverse articulation rod 8 which will connect their two transversely aligned links 3, 5 and 3', 5' to the central links 4", 4'" of the other two following modular assemblies 1", 1'" (not illustrated). By means of this variant, the strap can therefore grow in both directions.

Figure 9:
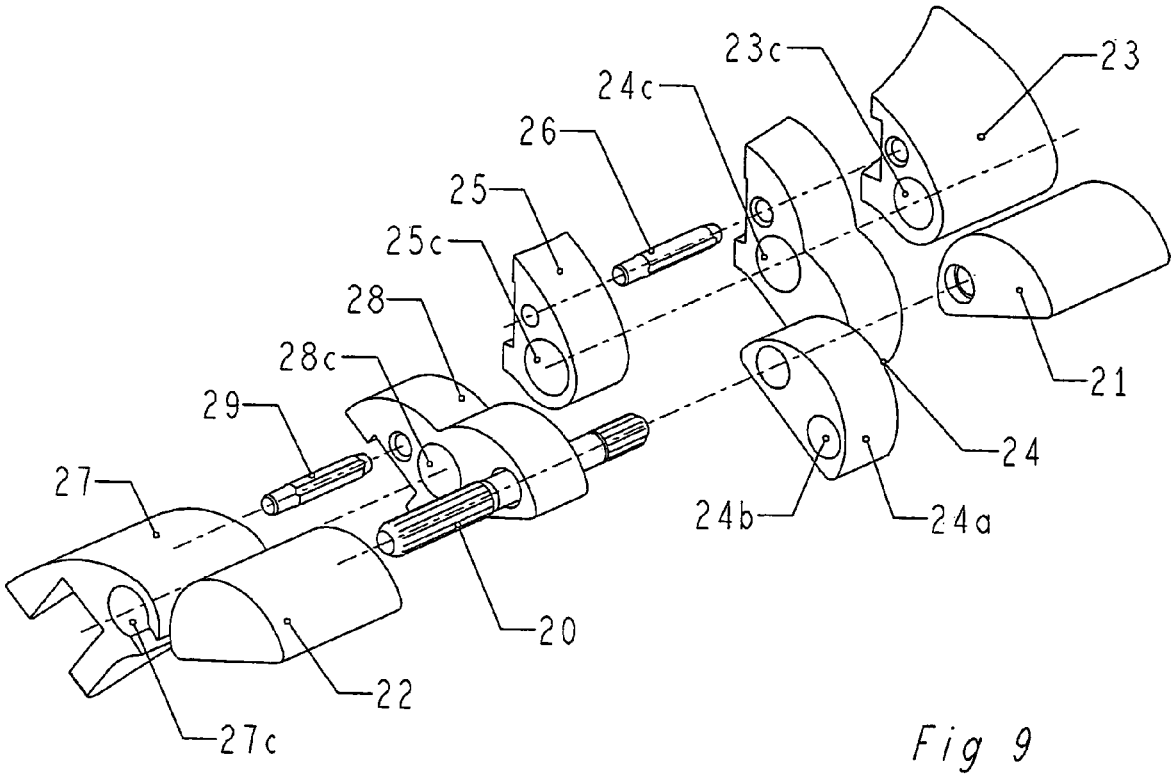
FIG. 9 is an exploded perspective view of a variant of the connecting element between one end of the strap and a watch case of FIG. 5.
Figure 10:
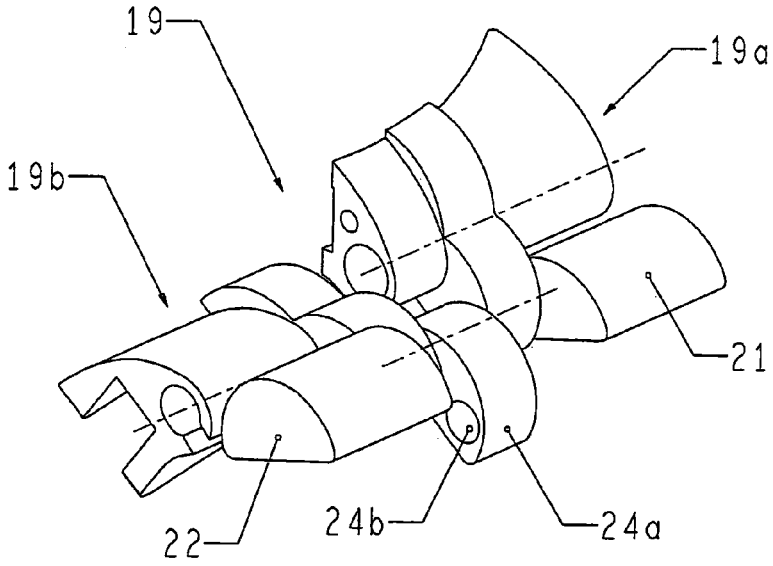
FIG. 10 is a perspective view of the connecting element of FIG. 9 in the assembled position.

FIGS. 9 and 10 show a variant of a connecting element 19 shaped so as to be accommodated between the horns (not illustrated) of a watch case, in order to connect one end of the strap, in particular according to the variant of FIG. 8, to this watch case. In contrast to the connecting element 9 in FIG. 5, this connecting element 19 is designed in two parts 19*a*, 19*b* capable of pivoting relative to one another about a transverse articulation rod 20. The ends of this transverse articulation rod are splined and driven into two respective receptacles of two lateral links 21, 22 integral with the part 19*b*.

The part 19*a* comprises three elements 23, 24 and 25 assembled by means of a driven transverse rod 26. The part 19*b* comprises four elements 21, 22, 27, 28 assembled by means of two rods 20, 29. Since the element 24 of the part 19*a* is mounted pivotable about the central part of the transverse articulation rod 20, the two parts 19*a*, 19*b* can pivot relative to one another, thus making it possible to tilt the element 24 in order to cause the transverse passage 24*b* of its part 24*a* to emerge from the inner space delimited by the inner lateral walls of the lateral links 21, 22, in order to introduce this passage between the two transversely aligned links 3, 5 of a modular assembly 1, for example that of FIG. 8, so as to introduce the transverse articulation rod 8 through the transverse passages 3*b*, 24*b*, 5*b* of these three links 3, 24*a* and 5.

The locking of the two parts 19*a*, 19*b* about the transverse articulation rod 20 is carried out when a bar (not illustrated) is introduced to the transverse passages 27*c*, 28*c*, 25*c*, 24*c*, 26*c* and 23*c* aligned with the axis of this bar, the two ends of which are accommodated in the usual way in suitable orifices formed in the inner lateral faces of these horns. In this position, the transverse articulation rod 8 between the last modular assembly 1 and the connecting element 19 butts at its two ends against the inner lateral faces of the lateral links 21, 22 of the connecting element 19 and is thus locked.

It goes without saying that, although FIGS. 1 to 4 show an embodiment in which the modular assemblies of a strap are assembled from a left-hand end to a right-hand end, it is possible for the direction of this assembly operation to be reversed.

The embodiment and variants described above all relate to a strap with five links. However, as it is possible to ascertain, in functional terms these five links actually form two parts, all the elements of which are integral with one another, so that there is, in actual fact, a modular assembly formed from two parts, as in the preceding embodiments comprising 5 links side by side.

Figure 11:
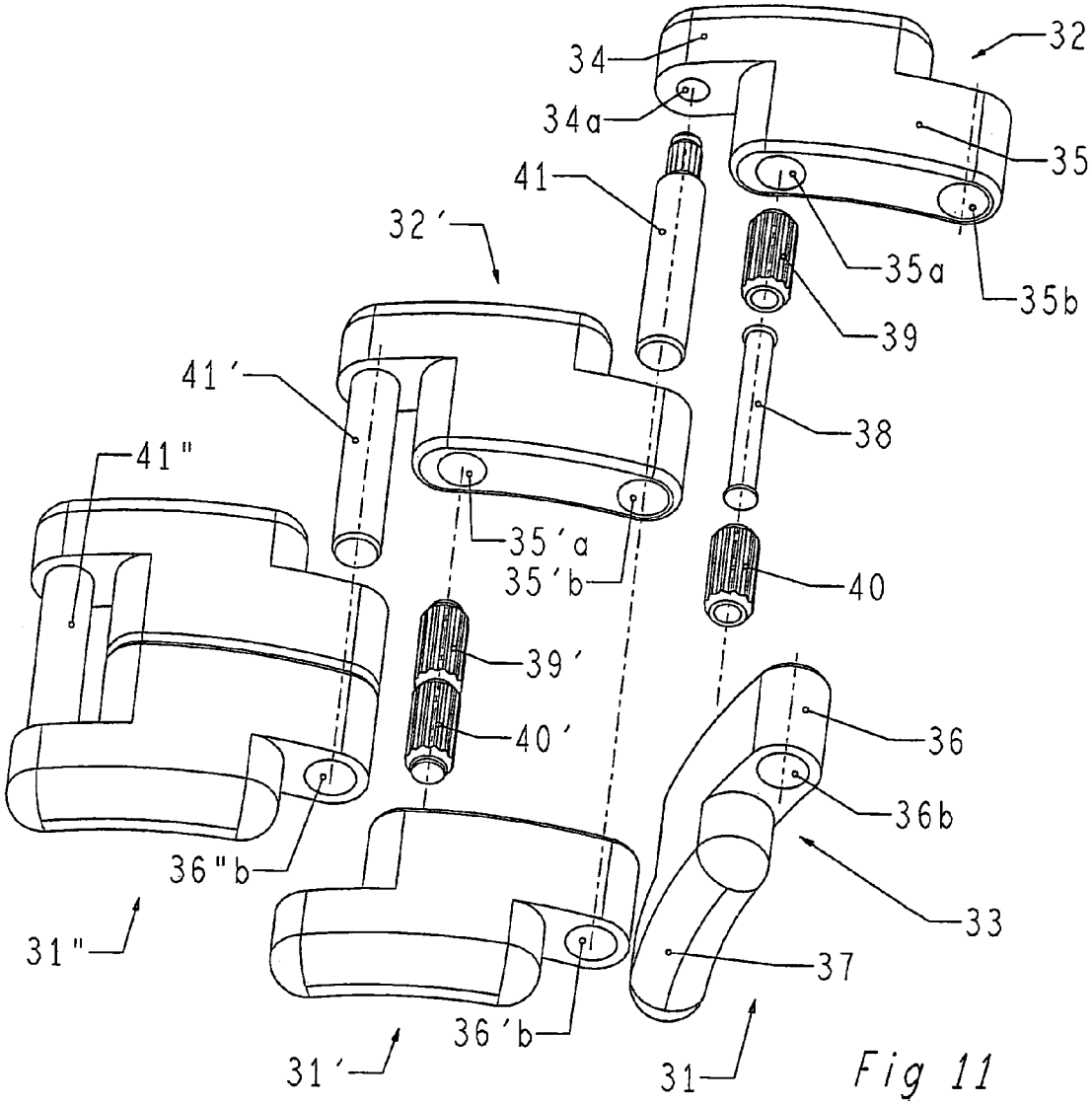
FIG. 11 is an exploded perspective view of a variant of the strap.
Figure 12:
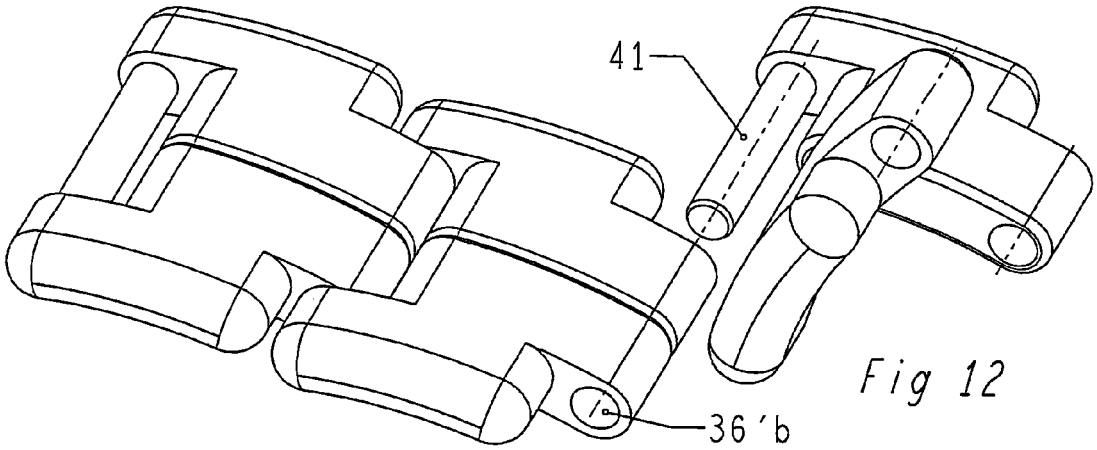
FIG. 12 is a perspective view of the variant of FIG. 11 during mounting.

The variant illustrated in FIGS. 11 and 12 show us how the concept of the present invention can be employed with regard to a strap comprising modular assemblies with four links which are integral in pairs. As can be seen from FIG. 11, each modular assembly 31, 31', 31" comprises two parts 32, 33 arranged mirror-symmetrically with respect to a longitudinal mid-axis of the strap. Each part 32, 33 comprises two links 34, 35 and 36, 37 formed here in one piece, so that these parts each comprise an inner portion formed by the links 35 and 36 and an outer portion formed by the links 34 and 37.

The two inner portions 35, 36 are connected independently of one another to the transverse center pin 38 by means of two tubular elements 39, 40, the length of which corresponds to the transverse dimension of each inner portion 35, 36. These tubular elements 39, 40 preferably have splined outer surfaces and are driven into orifices 35*a*, and 36*a* (which cannot be seen), of the portions 35 and 36. These tubular elements 39, 40 are retained axially on the transverse center pin by riveting to the two ends of this pin.

A transverse articulation rod 41 is driven into an orifice 34*a* formed in the inner lateral face of one of the outer portions 34, 37 of each modular assembly 31, 31', 31", and the length of said transverse articulation rod 41 is selected so that the free end of the latter does not project beyond that inner lateral face of the outer portion 37 which is opposite that 34 in which this rod 41 is fastened. Thus, according to the same inventive concept as that described above, the rod 41" located on the left in FIG. 11 is locked in the position illustrated in this figure, as soon as the rod 41' of the next modular assembly 31' is introduced into the two guide orifices 35"*b*, 36"*b*, placed coaxially to one another at the two inner portions 35", 36" of the modular assembly 31", as illustrated in FIG. 11. Thus, as can be seen in FIG. 12, putting in place the pins 41 of the modular assemblies 31, 31', 31" causes the immobilization of the two parts 32, 33 of these modular assemblies 31, 31', 31" and the locking of the transverse rods 41 between the two outer portions 34, 37 of the two parts 32, 33 of these modular assemblies 31, 31', 31", as the successive mounting of these modular assemblies progresses from left to right in the example described. Thus, the two inner portions 35, 36 of each modular assembly are also locked on these transverse rods 41 between the two inner lateral faces of the outer portions 34, 37 of the adjacent modular assembly.

The invention claimed is:

1. A wristband having a longitudinal direction and a transverse direction normal to the longitudinal direction, said wristband comprising:

(a) a plurality of center links disposed adjacent one to another in the transverse direction, each of said plurality of center links being offset with respect to each of an immediate neighboring center link in the longitudinal direction and wherein at least two of the plurality of center links are operatively, rigidly affixed to one another;

(b) at least one edge link, each disposed immediately adjacent to one of the plurality of center links;

(c) a first orifice extending entirely through each of the plurality of center links in the transverse direction;

(d) a second orifice extending entirely through each of the plurality of center links in the transverse direction wherein the second orifice in a first of the plurality of center links aligns with the second orifice in a second of the plurality of center links wherein a third of the plurality of center links resides between the first and second center links, and wherein the first orifice of the first of the plurality of center links aligns with the second orifice of the third of the plurality of center links, said third of the plurality of center links residing immediately adjacent to the first of the plurality of center links;

(e) a third orifice in the at least one edge link, said third orifice not extending entirely through the at least one edge link and aligned with the first orifice;

(f) a first connecting hinge pin arranged transversely to the plurality of links and operatively, pivotally disposed in the first orifice of the plurality of center links and the third orifice in the at least one edge link;

(g) a second connecting hinge pin arranged transversely to the plurality of links and operatively, disposed in the second orifice of all of said plurality of center links offset in a first longitudinal direction and in additional orifices of additional links longitudinally disposed from the plurality of center links, said second connecting pin not extending beyond an inner lateral edge of the at least one edge link; and (h) a third connecting hinge pin arranged transversely to the plurality of links and operatively, disposed in the second orifice of all of said plurality of center links offset in a second longitudinal direction, said second direction being not the first direction, said third connecting pin not extending beyond the inner lateral edge of the at least one edge link.

2. The wristband of claim 1 wherein the plurality of center links and the at least one edge link comprise a first modular assembly, the wrist band additionally comprising a second modular assembly operatively, pivotally connected to the first modular assembly by the second connecting hinge pin engaged in the second orifice in the second modular assembly.

3. The wristband of claim 1 wherein one of the plurality of center links adjacent to the at least one edge link is operatively, rigidly affixed to the edge link.

4. The wristband of claim 1 comprising two edge links, a first edge link disposed at a first edge and a second edge link disposed at a second edge transversely disposed from the first edge link.

5. The wristband of claim 1 wherein the at least two of the plurality of center links that are operatively, rigidly affixed to one another are immediately adjacent to one another.

6. The wristband of claim 2 wherein the plurality of center links of the first modular assembly consists of three center links.

7. The wristband of claim 2 wherein the at least one edge link of the first modular assembly consists of two edge links.

8. The wristband of claim 2 wherein every other of the plurality of center links of the first modular assembly resides in a same longitudinal position.

9. The wristband of claim 4 wherein the second connecting hinge pin is captive between inside edges of the two edge links.

10. The wristband of claim 2 additionally comprising a wristwatch case and wherein the third connecting hinge pin operatively, pivotally connects the first modular assembly to the wristwatch case.

11. The wristband of claim 1 additionally comprising:

(a) a wristwatch case;

(b) two horns operatively attached to the wristwatch case; and (c) an aperture in each horn, said aperture in a first horn in linear alignment with the aperture in a second horn, the third connecting hinge pin engaged in the aperture in each horn.

12. The wristband of claim 11 additionally comprising:

(a) internal threads in the aperture of at least one of the two horns; and (b) external threads disposed about the third connecting hinge pin, said external threads to mate to the internal threads.

13. The wristband of claim 2 wherein the first modular assembly and the second modular assembly comprise mirror images with respect to the second connecting hinge pin.

14. The wristband of claim 1 additionally comprising:

(a) a fourth orifice located in the at least one edge link;

(b) a fifth orifice located in all of said plurality of center links offset in the first longitudinal direction, the fifth orifice being aligned with the fourth orifice;

(c) two horns operatively attached to the wristwatch case;

(d) an aperture in each horn, said aperture in a first horn being coaxial with the aperture in a second horn and with the fourth and fifth orifices; and (e) a fourth connecting hinge pin engaged in the fourth orifice, the fifth orifice, and the aperture in each of the two horns.

15. The wristband of claim 2 wherein the plurality of center links and the at least one edge link comprise a first modular assembly, the wrist band additionally comprising a third modular assembly operatively, pivotally connected to the first modular assembly by the third connecting hinge pin engaged in the second orifice in the third modular assembly.

16. A wristband link assembly, a plurality of said wristband link assemblies being coupled together to comprise a wristband, the wristband link assembly comprising:

(a) two outer links each having a first aperture not passing entirely through at least one of the two outer links;

(b) two inner links, each inner link operatively, rigidly affixed to one outer link, said two inner links each having a second aperture passing entirely through the two inner links, and a third aperture;

(c) a first hinge pin engaged in the third aperture of both inner links; and (d) a second hinge pin engaged in the second aperture of both inner links of a first of the plurality of wristband link assemblies, and in the first aperture of one of the two outer links of a second of the plurality of wristband link assemblies.

* * * * *